US005269371A

United States Patent [19]

Boula et al.

[11] Patent Number: 5,269,371

[45] Date of Patent: Dec. 14, 1993

[54] HEAT EXCHANGER HAVING U-TUBES EQUIPPED WITH AN ANTI-FLY-OFF SUPPORT DEVICE

[75] Inventors: Gérard Boula, Corpeau; Jean-Pierre Roinjard, Fontaines; Christian Valadon, Paris, all of France

[73] Assignee: Framatome, Courbevoie, France

[21] Appl. No.: 981,229

[22] Filed: Nov. 25, 1992

[30] Foreign Application Priority Data

Nov. 27, 1991 [FR] France ..... 91 14655

[51] Int. Cl.[5] ..... F28F 9/00

[52] U.S. Cl. ..... 165/69; 165/162; 122/510

[58] Field of Search ..... 165/69, 162; 122/510

[56] References Cited

U.S. PATENT DOCUMENTS

| | | | |
|---|---|---|---|
| 2,853,278 | 9/1958 | Hesler . | |
| 3,007,679 | 11/1961 | Byerley et al. | 165/69 X |
| 3,199,582 | 8/1965 | Vogt et al. | 165/69 |
| 3,212,567 | 10/1965 | Romanos . | |
| 4,839,951 | 6/1989 | Boula et al. | 29/157.4 |
| 4,895,204 | 1/1990 | Johnson et al. . | |
| 4,991,645 | 2/1991 | Lagally et al. | 165/69 |
| 5,005,637 | 4/1991 | Gentry | 165/69 |
| 5,042,433 | 8/1991 | Monnier | 122/510 |

FOREIGN PATENT DOCUMENTS 0268147 6/1989 European Pat. Off. .

*Primary Examiner*—Allen J. Flanigan

*Attorney, Agent, or Firm*—Pollock, Vande Sande & Priddy

[57] ABSTRACT

In a heat exchanger, such as a steam generator equipping a nuclear power station, the intermediate inwardly curved parts (14*c*) of the U-tubes (14) grouped into a bundle forming parallel layers are maintained by antivibration bars (36*a*, 36*b*', 36*c*') placed between each pair of adjacent layers, these bars being interconnected outside the bundle by connecting pins (38*a*, 38*b*, 38*c*). To prevent the fly-off of the assembly formed by the antivibration bars and the connecting pins, at least part of the bars (36*a*, 36*b*', 36*c*') are placed in slots formed in an elongated structure (40) fixed to the spacing plate (34*a*) closest to the inwardly curved part of the tubes.

8 Claims, 4 Drawing Sheets

FIG. 1
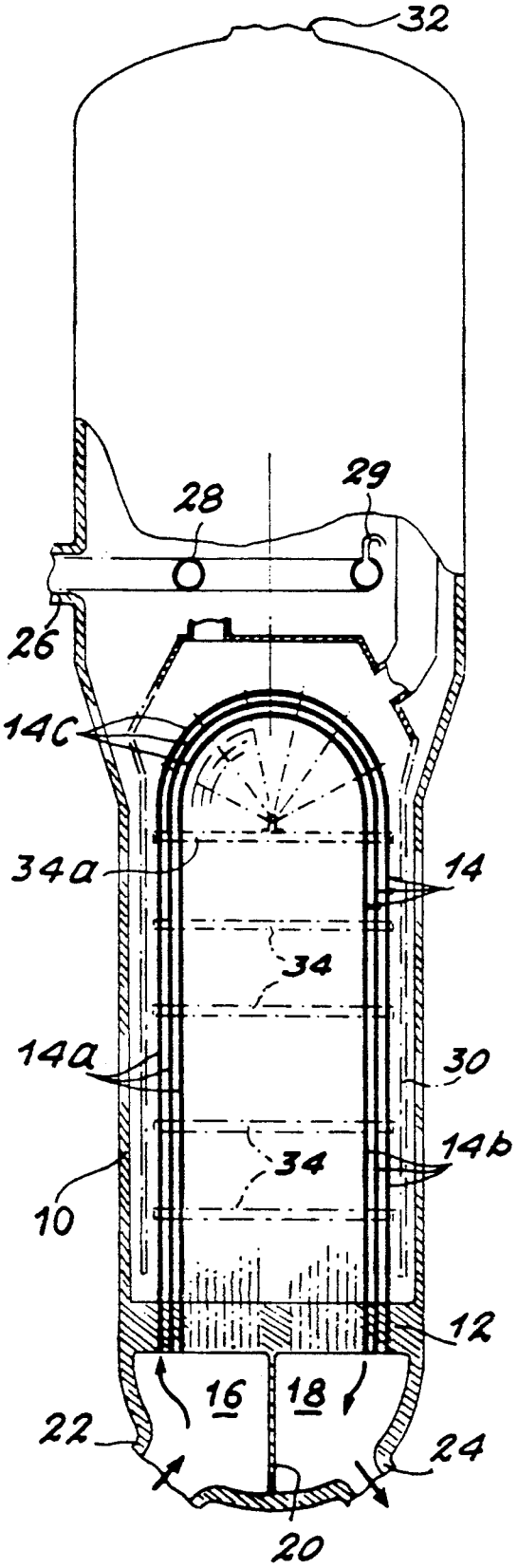
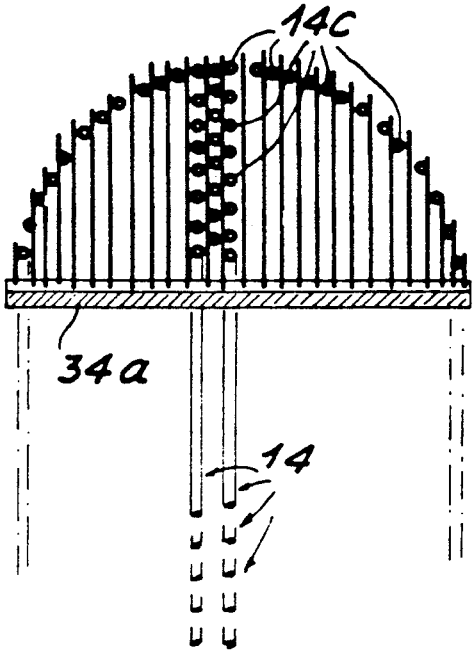
FIG. 2

HEAT EXCHANGER HAVING U-TUBES EQUIPPED WITH AN ANTI-FLY-OFF SUPPORT DEVICE

DESCRIPTION

The invention relates to a heat exchanger having a bundle or group of U tubes, whereof the intermediate, inwardly curved part is maintained by a novel type of anti-fly-off support device.

The invention more particularly applies to steam generators used in nuclear power stations for transferring heat between the primary and secondary circuits of the pressurized water reactor.

BACKGROUND OF THE INVENTION

In such steam generators, after heating in the reactor core, the water of the primary circuit (hereinafter called "primary water") circulates in an inverted U-tube bundle to transfer its heat to the secondary circuit water (hereinafter called "secondary water"), in order to convert it into steam.

More specifically, the inverted U-tube of the bundle are arranged in parallel layers and their rectilinear branches traverse horizontal spacing plates ensuring the relative positioning thereof over most of the height of the bundle.

In the upper part of the bundle, i.e., in the intermediate, inwardly curved part of the tubes, the maintaining of the relative positioning between the tubes is maintained by antivibration bars. More specifically, at least one more or less open V-shaped bar is normally placed between each pair of layers of adjacent tubes to prevent the vibration of the tubes in the upper part of the bundle and which could result from the circulation of the water inside and outside the tubes. All the antivibration bars are interconnected beyond the bundle of tubes by connecting or jointing pins welded to the ends of the bars.

As is more particularly illustrated by U.S. Pat. No. 3,007,679, in a device for supporting the upper part of the bundle of tubes, the flying off of the assembly formed by the connecting pins and the antivibration bars is normally prevented by anti-fly-off clips fixed to the connecting pins and encircling some of the tubes positioned outside the bundle.

In such a structure, the anti-fly-off clips suffer from the disadvantage of interconnecting several tubes of the bundle, which creates stresses in case of differential expansions of the tubes, particularly if one or more of them are blocked or sealed during the life of the steam generator.

SUMMARY OF THE INVENTION

The invention specifically relates to a heat exchanger, in which the tubes of the bundle are held or maintained in the upper part of the latter in conventional manner by antivibration bars interconnected by connecting pins, but in which the anti-fly-off clips conventionally used are eliminated and replaced by anti-fly-off means of a different type, which do not have the disadvantages of the clips and which can easily be assembled during the manufacture of the exchanger.

According to the invention, this result is obtained by means of a heat exchanger incorporating a bundle of U-tubes arranged in layers, each tube having two rectilinear portions and an intermediate, inwardly curved portion, spacing plates traversed by the rectilinear portions of the tubes, at least one antivibration bar placed between each pair of layers of adjacent tubes in the intermediate inwardly curved part thereof, connecting pins for the antivibration bars and anti-fly-off means for the assembly formed by the antivibration bars and the connecting pins. The anti-fly-off means comprise an elongated structure fixed to the spacing plate closest to the intermediate, inwardly curved parts of the tubes, within the inwardly curved parts and perpendicular to the layers, the elongated structure having, between each pair of layers of adjacent tubes, at least one slot for receiving an antivibration bar.

As a result of the fixing of the antivibration bars in slots formed on an elongated structure carried by the spacing plate closest to the inwardly curved parts of the tubes, the flying off of the assembly formed by the antivibration bars and the connecting pins is prevented without it being necessary to provide anti-fly-off clips, as in the prior art. Thus, there is no longer any risk of producing stresses between the tubes in case of differential expansions. Moreover, the arrangement proposed by the invention enables all the tubes of each layer to be supported by the antivibration bars, i.e., ranging from the smallest, which was not always the case in the prior art.

If at least two antivibration bars are placed between each pair of layers of adjacent tubes, the slots formed in the elongated structure incorporate groups of slots all receiving the antivibration bars placed between two adjacent layers, the groups of slots being regularly distributed every n layers (n being an integer at least equal to 2 and, e.g., equal to 8) and unitary slots each receiving the antivibration bar closet to the elongated structure for the remaining layers.

According to a preferred embodiment of the invention, the slots formed in the elongated structure issue onto an edge of the structure turned towards the inwardly curved parts of the tubes by means of access grooves, by which the antivibration bars can be introduced. In the case where the slots are in the form of groups of slots, all the slots of the same group issue onto this edge by a common access groove.

In order to permit an easy installation of the heat exchanger, e.g., according to the process described in U.S. Pat. No. 4,839,951, the access grooves are radially displaced towards the outside of the bundle of tubes with respect to the slots issuing into the grooves.

Preferably, the elongated structure comprises a rectilinear attachment rail fixed to the spacing plate closest to the inwardly curved parts of the tubes and perpendicular to the plate. As a function of the nature of the materials forming the attachment rail and the spacing plate, the rail can be directly welded to the plate or can be welded to at least one bed plate fixed to the spacing plate by fixing means such as screws.

BRIEF DESCRIPTION OF THE DRAWINGS

The invention is described in greater detail hereinafter with reference to the attached drawings:

FIG. 1 is a side view schematically illustrating, partly in vertical section, a steam generator according to the invention.

FIG. 2 is a sectional view in a vertical plane perpendicular to that of FIG. 1, illustrating the upper part of the bundle of tubes.

DESCRIPTION OF PREFERRED EMBODIMENT

Figure 3:
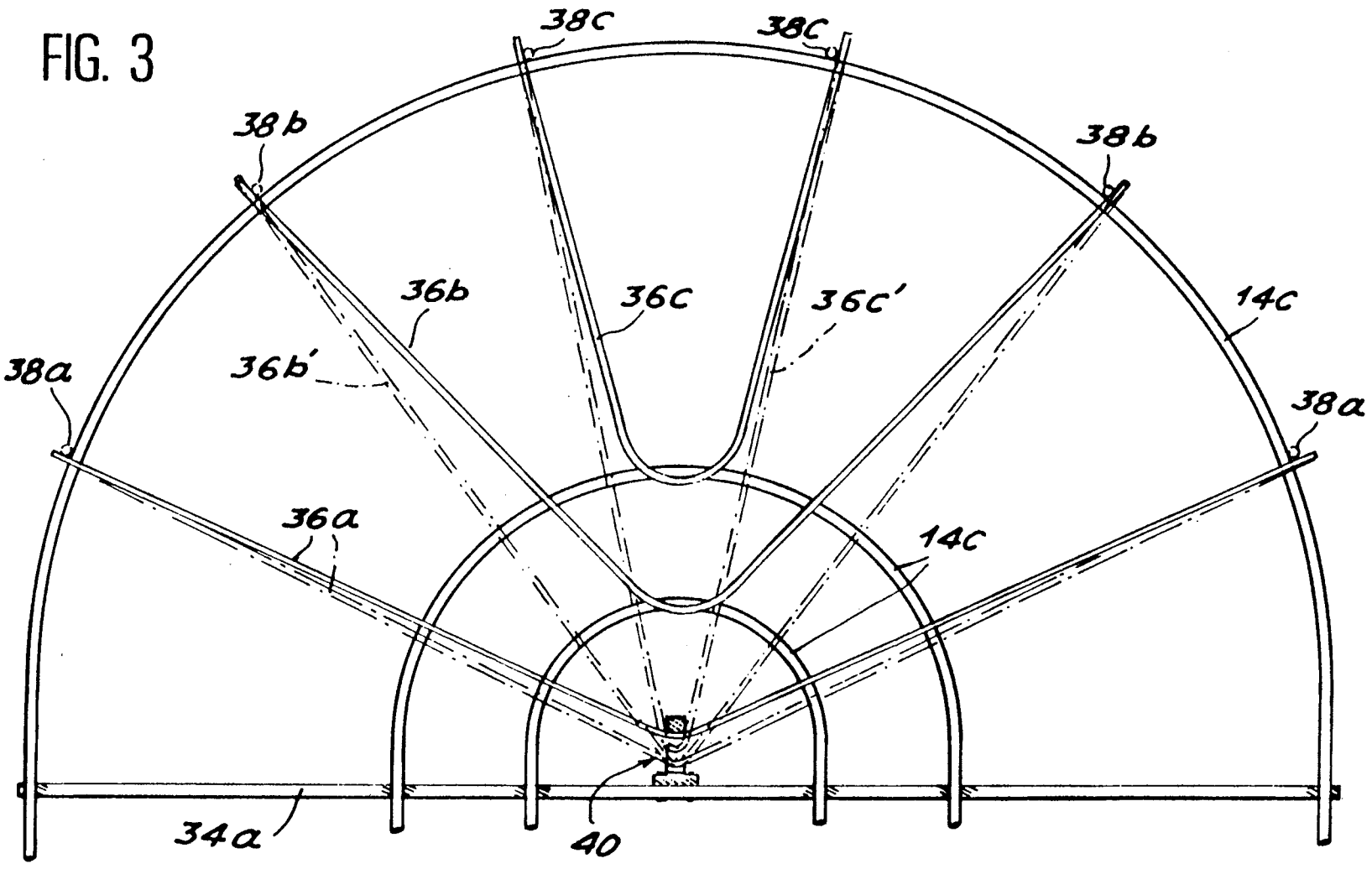
FIG. 3 shows on a larger scale the upper part of the bundle of tubes in a section along the plane of FIG. 1.

FIG. 1 shows schematically a steam generator for use in a nuclear power station and constructed in accordance with the invention. However, it is noted that the invention, can apply to any heat exchanger having U tubes arranged in bundle or group form, no matter what primary or secondary fluids flow in and around the tubes and no matter what the orientation of the tubes, the major axis of the bundle being orientable vertically, as in the described embodiment, horizontally or even obliquely.

In known manner, the steam generator of FIG. 1 comprises a vertically axial, outer cylindrical envelope 10, whose internal volume is subdivided into two parts by a horizontal plate 12, known as a tube plate, in the immediate vicinity of the convex bottom of the outer envelope 10. The tube plate 12 is traversed by a plurality of perforations, in which are fixed the lower ends of an assembly of inverted U tubes 14, said tubes being arranged in bundle form in that part of the outer envelope 10 which is located above the tube plate 12.

More specifically, the ends of each of the tubes 14 of the bundle are fixed to the tube plate 12 in such a way that the two ends of each tube issue below the tube plate 12, respectively in a primary water inlet chamber 16 and a primary water outlet chamber 18, separated from one another by a vertical partition 20. A primary water inlet pipe 22 and a primary water outlet pipe 24 respectively issue into the inlet and outlet chamber.

The secondary water is introduced into the outer envelope 10 by a secondary water inlet pipe 26 located at a level above the top level of the tube bundle 14 and connected to the interior of the steam generator by a torroidal collector 28 issuing over its entire periphery by inverted J-shaped tubes 29.

The secondary water introduced into the outer envelope 10 of the steam generator drops by gravity into an annular space formed between the outer envelope 10 and an inner envelope 30, which encircles the tube bundle 14 over its entire height and whose lower end is located in the vicinity of the tube plate 12. The secondary water then rises in the inner envelope 30, circulating around the tubes 14, so that it takes up some of the calories carried by the primary water and converts them into steam in the upper part of the inner envelope 30.

Still in known manner, the steam thus formed is taken up in the upper part of the inner envelope 30 and passes through conventional means (not shown) for water-steam separation and for drying the steam. Which are well known to the Expert and not shown in The dried steam then passes out of the steam generator through a secondary steam outlet pipe 32, which issues axially into the dome of the outer envelope 10.

Each of the inverted U tubes 14 of the tube bundle through which the heat exchange between the primary water and the secondary water takes place has two very long, rectilinear, vertical parts 14*a*, 14*b*, and an intermediate, inwardly curved, semicircular part 14*c* located in the upper part of the bundle.

As schematically illustrated in FIG. 1, the rectilinear parts 14*a*, 14*b* of the tubes 14 are supported by an assembly of spacing plates 34 arranged horizontally and equidistantly from one another over the entire height of the rectilinear parts 14*a*, 14*b* of the tubes in the bundle. These plates have perforations traversed by the tubes 14 and ensuring a controlled circulation of the secondary water around the tubes. The upper spacing plate 34*a* is positioned slightly below the horizontal axis, perpendicular to the plane of FIGS. 1 and 3, on which are centered all the inwardly curved parts 14*c* of the tubes 14.

As it is important better illustrated by FIG. 2, it is important the tubes 14 are arranged in layer form, i.e., in vertical planes parallel to the planes of FIGS. 1 and 3 and perpendicular to the plane of FIG. 2. Each of these layers has a number of tubes 14 progressively increasing on approaching the vertical axis of the steam generator, the tubes of each layer having intermediate, inwardly curved parts 14*c*, whose radius of curvature decreases radially towards the interior of the bundle, as illustrated in FIGS. 1 and 3.

In order to support the inwardly curved parts 14*c* of the tubes 14, which is not brought about by the spacing plates 34, antivibration bars are conventionally placed between each pair of adjacent tube layers. More specifically, in the embodiment illustrated in FIGS. 3 to 5, between each pair of adjacent tube layers 14 there are three antivibration bars 36*a*, 36*b*, 36*c* (or 36*a*, 36*b*', 36*c*'), all three being in the form of a V with a rounded apex and being symmetrically arranged with respect to the plane of symmetry of the bundle of tubes 14 passing through the vertical axis of the steam generator and oriented perpendicular to FIGS. 1 and 3.

The three antivibration bars 36*a*, 36*b*, 36*c* (or 36*a*, 36*b*', 36*c*') placed between each pair of adjacent tube layers essentially differ by their apex angle and by their position. Thus, the antivibration bar 36*a* closest to the upper spacing plate 34*a* has an obtuse apex angle, whereas the intermediate antivibration bar 36*b* (or 36*b*') has an apex angle close to 90° and the antivibration bar 36*c* (or 36*c*') closest to the upper spacing plate 34*a* has an acute apex angle.

According to a known procedure, all the antivibration bars 36*a* are interconnected, beyond the outer tubes of the tube bundle 14, by connecting pins 38*a* welded to the ends of the bars 36*a*, which project to the outside of the bundle. In the same way, the connecting pins 38*b* and 38*c* are respectively welded to the ends of the antivibration bars 36*b*, 36*b*' and 36*c*, 36*c*', beyond the outer tubes of the bundle of tubes 14, so as to interconnect all the antivibration bars 36*b*, 36*b*' and all the antivibration bars 36*c*, 36*c*'.

The invention more specifically relates to a novel type of anti-fly-off device, which is associated with the assembly formed by the antivibration bars 36*a*, 36*b*, 36*b*', 36*c*, 36*c*' and by the connecting pins 38*a*, 38*b*, 38*c*, in order to prevent the assembly from escaping partly from between the layers of tubes 14 under the effect of the vibrations produced in the latter by the circulation of the water.

Figure 4:
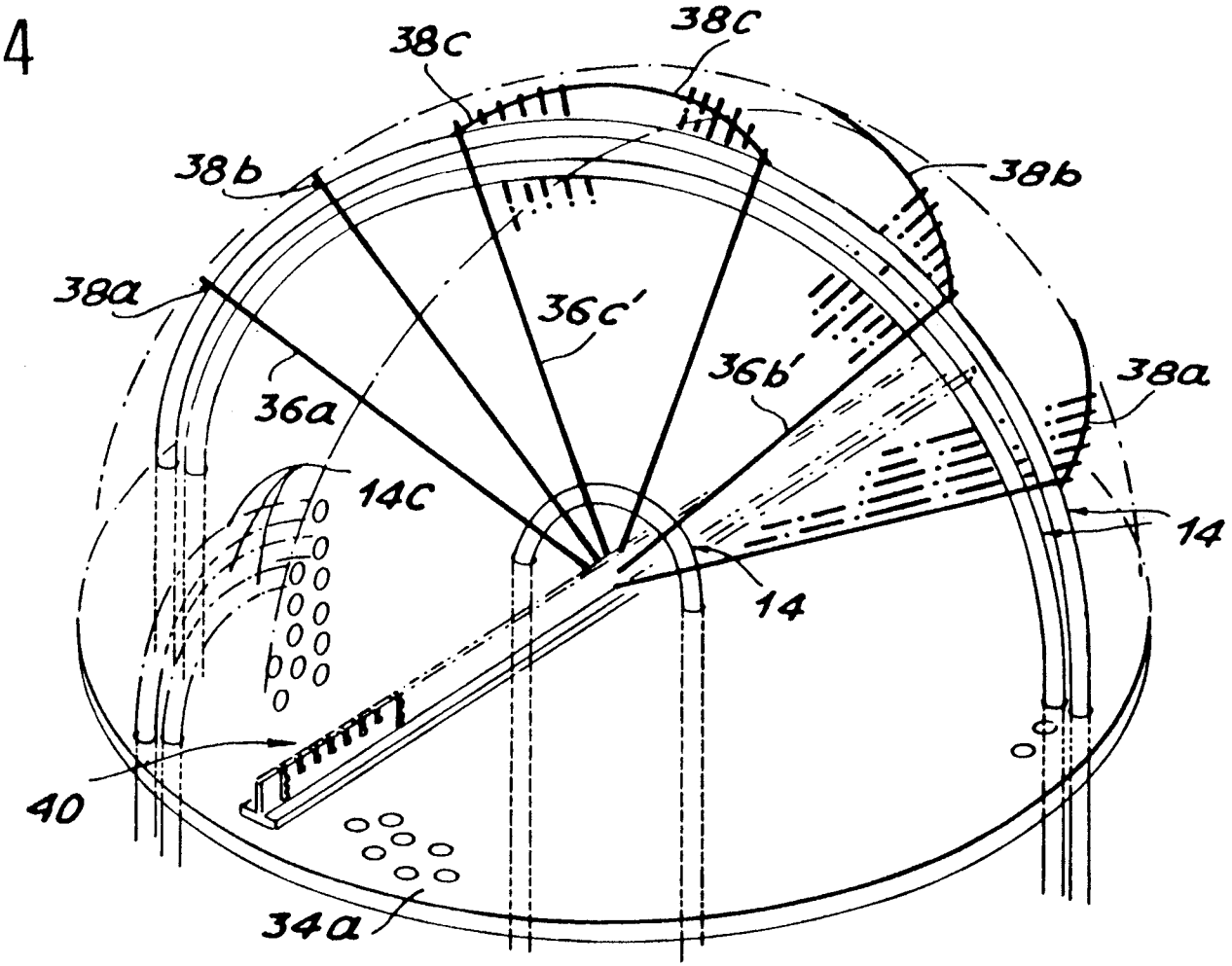
FIG. 4 is a perspective view more specifically illustrating the installation of the antivibration bars on an elongated structure fixed to the upper spacing plate, according to the invention.
Figure 5:
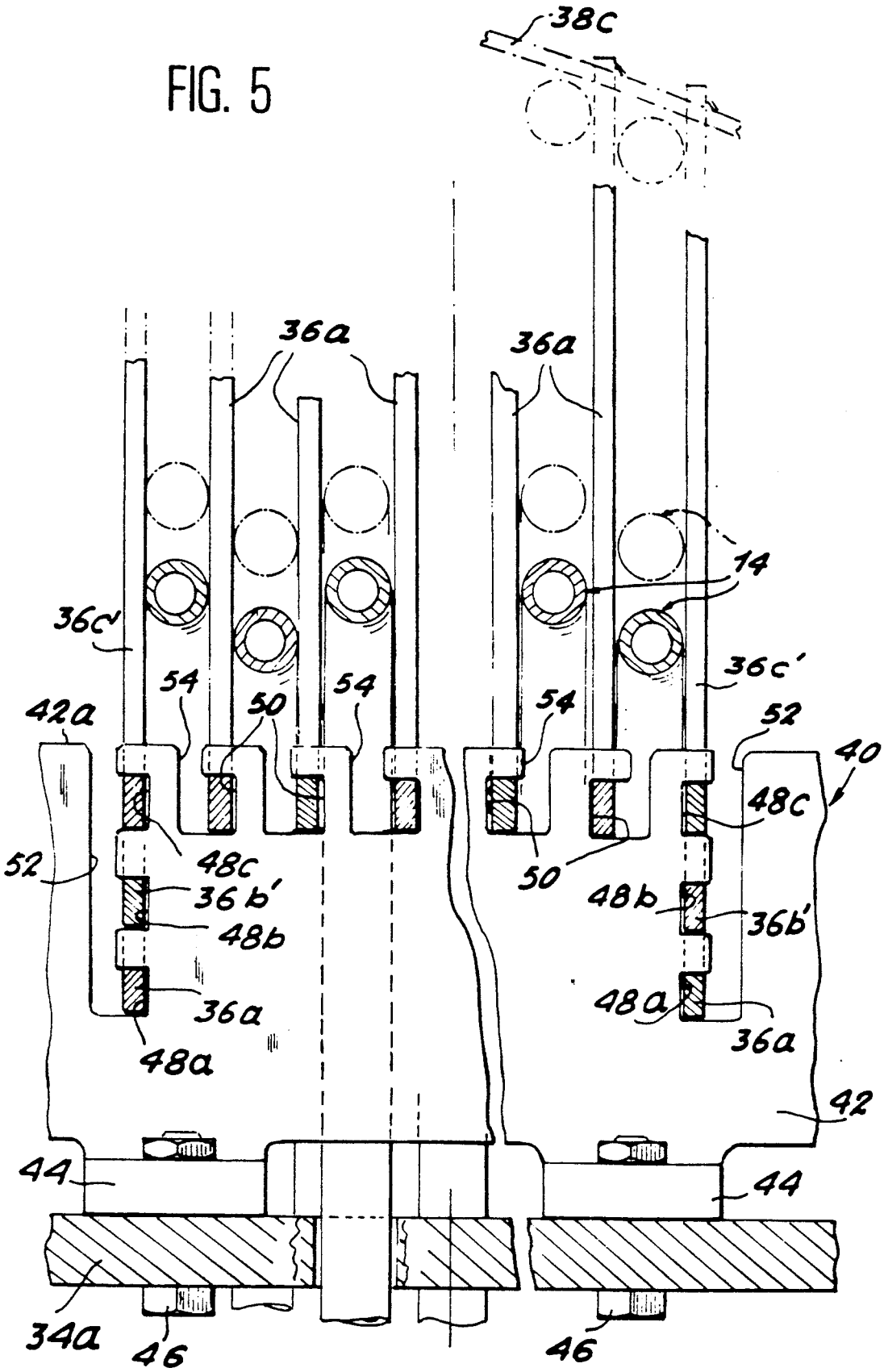
FIG. 5 is a sectional view along the same vertical plane as FIG. 2, illustrating on a larger scale the attachment of the antivibration bars to the elongated structure, which is fixed to the upper spacing plate of the steam generator.

As more particularly illustrated by FIGS. 3 to 5, the anti-fly-off device comprises an elongated structure 40 fixed to the upper spacing plate 34*a*, within the inwardly curved parts 14*c* of the tubes 14 of the bundle, perpendicular to the layers formed by the tubes, i.e., in a direction perpendicular to the planes of FIGS. 1 and 3 and passing through the vertical axis of the steam generator and on which are located the centers of the inwardly curved parts 14c of the tubes.

This elongated structure 40 mainly comprises a rectilinear attachment rail 42. In the embodiment illustrated in FIg. 5, the attachment rail 42 is welded to regularly distributed bed plates 44, which are themselves fixed to the upper spacing plate 34a by fixing means such as screws or bolts 46.

It should be noted that in a constructional variant (not shown), the bed plates 44 can be replaced by a single bed plate extending over the entire length of the attachment rail 42.

In another unillustrated embodiment, the attachment rail 42 can also be directly welded to the upper spacing plate 34a, if this is permitted by the materials forming these two parts.

As is more specifically illustrated by FIGS. 4 and 5, the attachment rail 42 has over its entire length slots in which are received the central parts of the antivibration bars 36a, 36b' and 36c'.

Thus, between certain pairs of adjacent tube layers, the attachment rail 42 has groups of three slots 48a, 48b, 48c and between other adjacent tube layer pairs, a single slot 50. More specifically, the groups of three slots 48a, 48b, 48c are regularly distributed every eight tube layers in the represented embodiment, whereas the attachment rail 42 has a single slot 50 for all the remaining layers.

Each of the groups of three slots 48a, 48b, 48c is placed in a plane containing a group of three antivibration bars 36a, 36b', 36c' and the three slots issue onto an edge 42a of the attachment rail 42 turned towards the inwardly curved parts 14c of the tubes by a common access groove 52.

Moreover, each unitary slot 50 is also placed in the same plane as a group of three antivibration bars 36a, 36b, 36c, but it only receives the central part of the antivibration bar 36a closest to the axis of the bundle of tubes. These unitary slots 50 are aligned with the slots 48c of the groups of slots 48a, 48b, 48c closest to the edge 42a of the rail 42.

The antivibration bars 36a are also introduced into the slots 50 by an access groove 54, which issues onto the edge 42a of the attachment rail 42.

The access grooves 52 and 54 are oriented parallel to the planes containing the groups of antivibration bars 36a, 36b', 36c' and 36a, 36b, 36c corresponding thereto and are radially displaced towards the outside of the tube bundle with respect to these planes.

Thus, the antivibration bars 36a, 36b' and 36c' can be successively introduced by the groove 52 and put into place in the corresponding slots 48a, 48b and 48c after the adjacent layer of tubes 14 closest to the axis of the bundle of tubes has been put into place. When the following tube layer is in turn installed on the apparatus, the antivibration bars 36a, 36b' and 36c' are automatically held.

In a comparable manner, the antivibration bar 36a of each of the groups of bars 36a, 36b, 36c can be introduced into the slot 50 by the groove 54 after the adjacent tube layer closest to the bundle axis has been put into place. This antivibration bar 36a is secured when the following tube layer has been put into place.

It should be noted that the antivibration bars 36a closest to the axis of the bundle of tubes are almost the same when said bars are engaged in the slots 48a and when they are engaged in the slots 50. Conversely, the antivibration bars 36b' and 36c', which are engaged in the slots 48b and 48c have a smaller apex angle than the corresponding antivibration bars 36b, 36c, which are not engaged in these slots. To distinguish these two types of antivibration bars, those which are not engaged in the slots have been designated by the references 36b, 36c, whereas those engaged in the slots 48b, 48c are designated by the references 36b' and 36c' in FIGS. 3 to 5.

The assembly of the steam generator tubes 14 according to the invention advantageously takes place in accordance with the aforementioned U.S. Pat. No. 4,839,951.

As a result of the structure described in detail hereinbefore with reference to FIGS. 3 to 5, the assembly constituted by the antivibration bars 36a, 36b, 36c, 36b' and 36c' and by the connecting pins 38a, 38b, 38c is attached to the upper spacing plate 34a, in such a way that it cannot fly off, without it being necessary to make use of anti-fly-off clips, which may produce stresses in the case of differential expansions between the tubes encircled by the clips, particularly if one or more of the tubes are blocked.

This structure also makes it possible for the antivibration bars 36a, 36b, 36c, 36b' and 36c' to support all the tubes 14 of each layer, i.e., ranging from the smallest bending radius of the inwardly curved part 14c to the largest.

Moreover, the anti-fly-off device according to the invention permits the easy installation of the antivibration bars as the different layers of tubes 14 of the bundle are installed. Thus, the steam generator assembly procedure remains substantially unchanged.

The invention can be used no matter how many antivibration bars are placed between successive layers of tubes, and the attachment of the bars can involve all of them or only some, as in the embodiment described. In the latter case, groups of slots receiving all the corresponding antivibration bars must be distributed among the unitary slots every n layers of tubes, so that the assembly is held in place. The number n can be a random number equal to or greater than two.

We claim:

1. Heat exchanger incorporating a bundle of U tubes arranged in layers, each tube having two rectilinear portions and an intermediate, inwardly curved portion, spacing plates traversed by the rectilinear portions of the tubes, at least one antivibration bar placed between each pair of layers of adjacent tubes in the intermediate inwardly curved part thereof, connecting pins for the antivibration bars and anti-fly-off means for the assembly formed by the antivibration bars and the connecting pins, wherein the anti-fly-off means comprise an elongated structure fixed to the spacing plate closest to the intermediate, inwardly curved parts of the tubes, within said inwardly curved parts and perpendicular to said layers, said elongated structure having, between each pair of layers of adjacent tubes, at least one slot for receiving an antivibration bar.

2. Heat exchanger according to claim 1, wherein at least two antivibration bars are arranged between each pair of layers of adjacent tubes, the slots formed in the elongated structure incorporating groups of slots receiving all the antivibration bars placed between two adjacent layers, said groups of slots being regularly distributed every n layers, and unitary slots each receiving the antivibration bar closest to the elongated structure for the remaining layers.

3. Heat exchanger according to claim 2, wherein the slots formed in the elongated structure issue onto the edge of said structure turned towards the inwardly curved part of the tubes by access grooves.

4. Heat exchanger according to claim 3, wherein the slots of the same group of slots issue onto said edge by a common access groove.

5. Heat exchanger according to claim 3, wherein the access grooves are radially displaced towards the outside of the bundle of tubes with respect to the slots issuing into said grooves.

6. Heat exchanger according to claim 1, wherein the elongated structure comprises a rectilinear attachment rail fixed to the spacing plate closest to the inwardly curved parts of the tubes and perpendicular to said plate.

7. Heat exchanger according to claim 6, wherein the attachment rail is welded to at least one bed plate fixed to the spacing plate by fixing means.

8. Heat exchanger according to claim 6, wherein the attachment rail is directly welded to the spacing plate.

* * * * *